US005224364A

United States Patent [19]

Claar et al.

[11] Patent Number: 5,224,364

[45] Date of Patent: Jul. 6, 1993

[54] DEVICE FOR SENSING ROTARY ANGLES OF A LOCK CYLINDER IN A KEY-ACTUATED LOCK SYSTEM

[75] Inventors: Klaus Claar, Gechingen; Jürgen Schrader, Stuttgart; Martin Lindmayer, Leonberg, all of Fed. Rep. of Germany

[73] Assignee: Mercedes-Benz AG, Fed. Rep. of Germany

[21] Appl. No.: 672,315

[22] Filed: Mar. 20, 1991

[30] Foreign Application Priority Data

Mar. 20, 1990 [DE] Fed. Rep. of Germany ..... 4008834

[51] Int. Cl.[5] ..... E05B 65/36

[52] U.S. Cl. ..... 70/237; 70/255; 70/257; 70/264; 70/DIG. 30; 200/574; 307/10.2

[58] Field of Search ..... 70/237, 239, 241, 255, 70/257, 264, DIG. 30, DIG. 42; 174/52.3; 200/573, 574, 331, 336; 307/10.2; 361/172

[56] References Cited

U.S. PATENT DOCUMENTS

| | | | |
|---|---|---|---|
| 1,395,881 | 11/1921 | Wattel | 70/237 |
| 1,670,043 | 5/1928 | Mott | 70/239 |
| 1,725,158 | 8/1929 | Pinkerton | 70/241 |
| 2,795,127 | 6/1957 | Gust | 70/264 |
| 2,996,910 | 8/1961 | Willis | 70/264 |
| 3,000,204 | 9/1961 | De Vito | 70/264 |
| 3,747,379 | 7/1973 | Cabanes | 70/264 |
| 4,158,299 | 6/1979 | Grabner et al. | 70/224 |

FOREIGN PATENT DOCUMENTS

| | | |
|---|---|---|
| 2164651 | 6/1973 | Fed. Rep. of Germany . |
| 3639043 | 1/1988 | Fed. Rep. of Germany . |
| 3636828 | 11/1988 | Fed. Rep. of Germany . |
| 3717778 | 3/1989 | Fed. Rep. of Germany . |
| 3513555 | 4/1989 | Fed. Rep. of Germany . |
| 3827564 | 5/1989 | Fed. Rep. of Germany . |

*Primary Examiner*—Lloyd A. Gall
*Attorney, Agent, or Firm*—Evenson, McKeown, Edwards & Lenahan

[57] ABSTRACT

A device is disclosed for sensing the rotary angle of a key-actuated lock system which contains a lock cylinder of a door or flap of a vehicle which is rotatable by way of a key. A follower is coupled to the lock cylinder via a driving coupling allowing a free-wheel rotational play and to a protection element of a lock and is rotatably mounted in a door interior. A switch-actuating part is rotationally coupled to the lock cylinder virtually free of play and is rotatable synchronously with the lock cylinder and a control switch which is switchable by the switch-actuating part at a specific rotary angle of the part and directly spatially adjacent thereto. The switch-actuating part is mounted behind the follower in relation to the lock cylinder on a carrier facing the interior of the vehicle and is fixed to the door or flap. A control switch is retained at least indirectly on the same carrier, and at least these two parts are sealed off relative to the door interior.

20 Claims, 1 Drawing Sheet

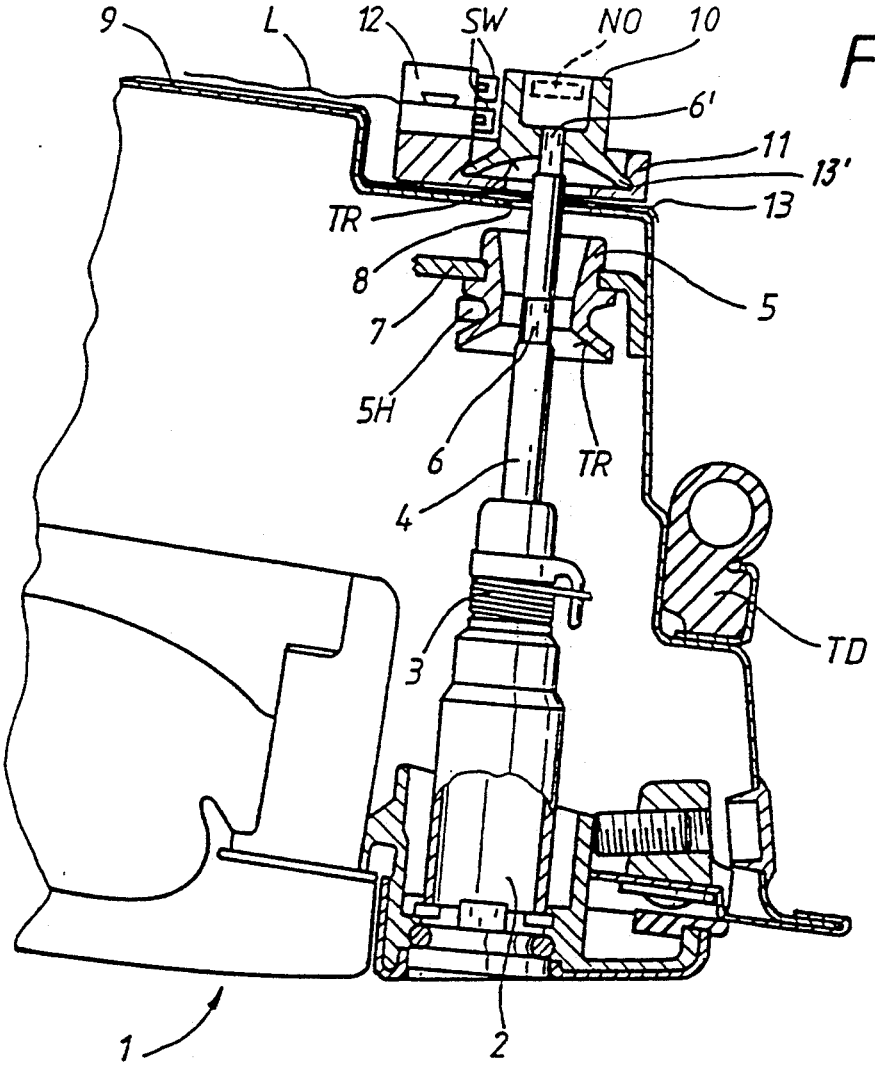
Fig. 1
Fig. 3
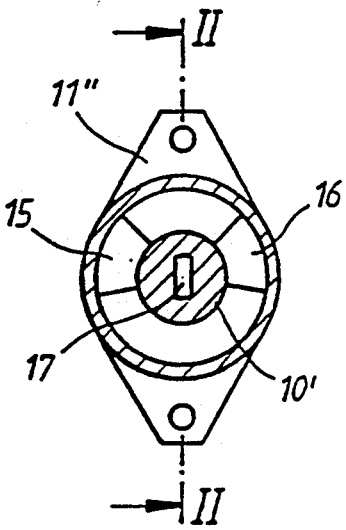
Fig. 2
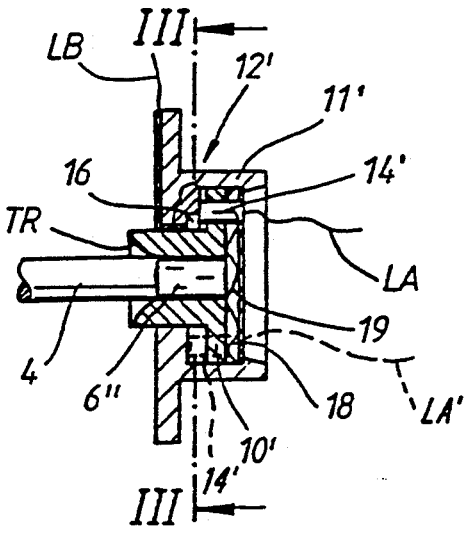

DEVICE FOR SENSING ROTARY ANGLES OF A LOCK CYLINDER IN A KEY-ACTUATED LOCK SYSTEM

BACKGROUND AND SUMMARY OF THE INVENTION

The present invention relates to a device for sensing rotary angles of a lock cylinder in a key-actuated lock system, and, more particularly, to a device in which the switch-actuated part for the control switch is mounted behind the follower in relation to the lock cylinder on a carrier facing the interior of a vehicle and fixed to a door or flap, the control switch is retained at least indirectly on the same carrier and the switch-actuating part and the control switch are sealed off in relation to the door interior.

A device for sensing rotary angles of a vehicle lock cylinder is shown in DE 3,827,564 C1, wherein a microswitch is spatially assigned to a follower rotationally coupled to the lock cylinder. This follower is divided into two part sleeves which are rotatable relative to one another with the first part sleeve corresponding in functional terms to a conventional follower, in order to provide a free-wheel or key-return play allowing a neutral key withdrawal position of the lock cylinder and, with the second part sleeve rotationally coupled virtually free of play to the lock cylinder, to allow the clearly defined post-triggered actuation of the microswitch.

For sensing the rotary angles of the lock cylinder or for actuating the microswitch, the second part sleeve has switch cams corresponding to specific rotary angles of the lock cylinder. The microswitch serves for triggering specific switch functions associated with vehicle locking, for example as a control switch of an additional mechanical theft protection apparatus. Because the second part sleeve is uncoupled mechanically from the follower and therefore also from the conventional inner door security (sill button), the known device also ensures that the theft protection device cannot be switched on or off as a result of the actuation of the inner door security because the microswitch remains unactuated during this actuation.

Although this known device makes the lock cylinder very compact in view of the limited installation space in doors of modern motor vehicles, nevertheless the follower is still arranged in the so-called "wet region" of the inside of the door, with the result that a watertight design of the microswitch becomes necessary.

Furthermore, during the assembly of the lock, the electrical plug connection of the microswitch also has to be inserted, and because of the confined installation conditions this too presents problems. This construction is, however, unavoidable in order to avoid making the installation of the lock itself needlessly difficult because of an electrical lead hanging on the follower.

An object of the present invention is to configure a device for sensing rotary angles of a vehicle lock cylinder such that, while the uncoupling of the switch actuation from the follower and from the lock cylinder is maintained, a conventional one-part follower can be provided and the switch itself can be of simpler design.

This object has been achieved according to the present invention by mounting the switch-actuated part for the control switch behind the follower in relation to the lock cylinder and a carrier facing the interior of the vehicle and fixed to the door or flap, retaining the control switch at least indirectly on the same carrier, and sealing off at least the switch-actuating part and the control switch in relation to the door interior.

Because, according to the invention, the switch-actuating part for the control switch is mounted behind the follower in relation to the lock cylinder on a carrier facing the interior of the vehicle and formed by the inside door or flap panel, it is possible to use simpler one-part followers and to install control switches which are not sealed off against the wet and are therefore substantially more cost-effective, since these are now likewise fastened to the same carrier in the interior of the vehicle, e.g. on the side of the carrier facing the interior, under the conventional inner door or flap trim, and are sealed off relative to the door interior.

In a simple manner, the switch-actuating part of the present invention can be coupled to the lock cylinder via the conventional rotary rod by extending the latter so that it passes axially through the follower. Appropriate driving elements for the follower or its coupling with rotational play to the lock cylinder are provided at the point of the rotary rod located in the follower in the assembled state. At its end, the rotary rod is suitably engaged behind the follower, virtually free of play, with the rotatably mounted switch-actuating part.

As control switches, either conventional microswitches can be used or, in an advantageous construction of the device according to the present invention, a very compact constructional unit consisting of a carrier part, switch-actuating part and control switch can be provided.

BRIEF DESCRIPTION OF THE DRAWINGS

These and further objects, features and advantages of the present invention will become more apparent from the following detailed description of presently preferred embodiments when taken in conjunction with the accompanying drawings wherein:

FIG. 1 is a partial sectional view of a first embodiment of the present invention with conventional microswitches;

FIG. 2 is a cutaway section along line II—II of hereinafter described FIG. 3 of a second embodiment of the present invention with a special configuration of a carrier part as a constructional unit with a switch-actuating part and two control-switch contacts; and FIG. 3 is a sectional view along line III—III of FIG. 2.

DETAILED DESCRIPTION OF THE DRAWINGS

In FIG. 1, a lock cylinder 2 is fastened in the outer shell of a motor-vehicle door 1 and is prestressed by a return spring 3 into a neutral key withdrawal (or insertion) position. By means of a key (not shown), the lock cylinder 2 can be rotated to the right and left, starting from the key withdrawal position, counter to the force of this return spring 3. Via a rotary rod 4 fastened to the rear side of the lock cylinder 2 facing away from the keyhole (also not shown), a follower 5 is coupled in a known way to the lock cylinder 2 via a coupling with rotational play. In the region located in the follower 5 in the illustrated final assembled state, the rotary rod 4 is equipped with driving elements 6 which correspond to driving elements of the follower 5. In the "wet region" of the door interior, the follower 5 is mounted rotatably in a lock carrier plate 7.

During the rotation of the lock cylinder 2 out of its neutral position, the follower 5 is driven so that the associated lock of the type shown in FIG. 1 of U.S. Pat. No. 4,158,299 is unlocked or locked via a suitable lever connection indicated merely by an extension 5H of the follower 5. During the return of the lock cylinder 2 into its neutral position via the return spring 3, the follower 5, the lever connection and the lock itself remain in the particular unlocked or locked position. As seen from the lock cylinder 2, the rotary rod 4 is extended axially out through the follower 5 and passes through an orifice 8 in a carrier plate 9 which is formed by the inside door panel facing the interior or passenger space of the vehicle. A switch-actuating part 10 with a seal portion 13' is rotatably mounted concentrically relative to the orifice 8 in a carrier part 11 which also carries two microswitches 12 and which is itself fastened to the carrier plate 9. Preferably, a known snap connection (not shown) is provided between the carrier part 11 and the carrier plate 9. In the delivered state of the vehicle, the inside door panel and therefore the carrier plate 9 and the entire switch arrangement are concealed by an inner door trim.

Both the follower 5 and the switch-actuating part 10 each have, on their side facing the lock cylinder 2, a funnel contour TR which makes it easier, during the installation of the lock cylinder 2, to introduce the rotary rod 4 to be coupled positively to the two parts. The contour TR centers the end of the rotary rod in the direction of the central passage orifice of the follower 5 or of the switch-actuating part 10. The switch-actuating part 10 is equipped on its outer circumference located opposite the microswitches 12, in a known way with cams NO which are arranged in different planes and are distributed over the circumference according to the requirements for the switch points of the microswitches 12 and which correspond to switchrockers SW of the two microswitches 12. Only one cam NO arranged in the same, horizontal, plane as the switch rocker of the upper microswitch 12 is shown, whereas another cam arranged in the plane of the switch rocker of the lower microswitch 12 cannot be seen because of the sectional representation of the switch-actuating part 10.

An electrical multiple lead L is connected directly to the microswitches 12, without a plug connection being interposed, and is sealed externally together with these microswitches which are therefore fixed constituents of the door cable harness which is conventionally connected to the power supply of the vehicle at the central door disconnection point. The assembly of the lock is not impaired thereby, because the microswitches 12 according to the present invention are in any case previously fastened to the carrier plate 9 by the carrier part 11 separately from the lock cylinder 2 and from the lock.

The illustrated embodiment also ensures that, when the locked lock is unlocked mechanically from the inside, the switch-actuating part 10 is not co-rotated synchronously with the follower 5, thereby reliably preventing, for example, a mechanical theft protection controllable by the microswitches 12 from being influenced via the inner door security. As result of the freewheel play mentioned, the follower 5 is rotatable in relation to the lock cylinder 2, but because of the positive coupling with the rotary rod 4 the switch-actuating part 10 is not and can be rotated only by the key inserted in the lock cylinder 2.

The orifice 8 is sealed off by a foil 13 introduced between the carrier part 11 and the carrier plate 9. Of course, if required, at this point there can also be other sealing devices, e.g., foam sealing rings, etc., through which the rotary rod 4 passes within the orifice 8. The gap bet ween the door and the body is sealed off in the usual way by a door seal TD.

It is also possible to provide the seal between the switch-actuating part 10 and the carrier part 11, for example as a lip seal on the outer circumference or on the outer edge of the funnel contour TR of the switch-actuating part 10. In this situation, the receiving bore of the switch-actuating part 10 for the free end of the rotary rod 4 must either be designed as a blind hole or be sealed off relative to the vehicle interior or to the control switches 12 in another suitable way.

For the rotational coupling between the switch-actuating part 10 and the rotary rod 4 which must be configured to be as free of play as possible, any positive connection elements, e.g., corresponding square or polygonal cross-sections, but also toothings, can be used. A square cross-section 6' at the free end of the rotary rod 4 is shown.

In another embodiment of the device according to the invention, shown sectioned in FIGS. 2 and 3, a carrier part 11', which is provided in the region of the orifice 8 for direct mounting on the carrier plate 9 shown in FIG. 1, can advantageously be configured as a compact constructional unit with a switch-actuating part 10', a movable contact pin 14 and switch segments 15, 16 which together form at least one control switch 12'. The carrier part 11' has a flange 11'' and passage orifices (unnumbered) for screws for fastening to the carrier plate 9. Here, the switch-actuating part 10' has a driving slot 17 which is arranged concentrically relative to its axis of rotation and which is brought into engagement with a corresponding flat end cross-section 6'' of the rotary rod 4, only a portion of which is shown. A rotational coupling can also be used for the switch-actuating part 10 illustrated in FIG. 1.

As is evident from FIG. 3, switch segments 15 and 16 can be considered as fixed contacts of the control switch 12' and are inserted into the carrier part 11' flush with its surface. The contact pin 14 is a switch contact of the control switch 12', and is fastened in the switch-actuating part 10' itself. The pin 14 can be connected electrically via a lead wire LA, and the switch segments 15 and 16 are either connected jointly to the vehicle frame without their own lead or connected individually to different terminals via further lead wires LB which, as indicated, run within the carrier part 11', e.g., through recesses, grooves or bores formed therein.

In the case of the same electrical potential of both switch segments 15, 16, a single-pole control switch 12' which is switchable independently of the direction of rotation of the lock cylinder 2 or of the rotary rod/-switch-actuating part 10' is provided. In the case of different electrical potentials or terminals of the switch segments, there is a pole-changing touch-contact switch 12' with a neutral middle position or the equivalent arrangement of two single-pole touch-contact switches, each of which is switchable in a specific direction of rotation.

The switch actuating part 10' is fastened in the carrier part 11' by a snapped-in cover disk 18 and is prestressed away from the cover disk 18 towards the switch segments 15 and 16 by a cup spring 19. This ensures a reliable contacting of the contact pin 14 with the switch segments at the corresponding rotary angles of the lock cylinder which differ from the neutral position.

The advantage of the embodiment according to FIGS. 2 and 3 in relation to the use of the microswitches 12 shown in FIG. 1 is that, as a result of the spatial arrangement of the switch segments 15, 16, the switch points of the control switch formed by these segments and by the contact pin 14 can be maintained with substantially greater accuracy.

The use of a simplified integrated switch form with exposed contacts is made possible only by the arrangement according to the present invention of the control switch outside the at least damp door interior. Also, in this second embodiment the switch-actuating part 10' and the control switch 12' can once again be sealed off relative to the door interior by a sealing foil glued in between the carrier part 11' and the carrier plate 9. If necessary, however, a toroidal sealing ring or another suitable seal can also be provided between the carrier part 11' and the switch-actuating part 10', for example on the outer circumference of the neck-shaped portion of the switch-actuating part 10' equipped with a driving slot 17 and rotatably mounted in the carrier part 11'.

Only one movable contact pin 14 which comes into electrical contact with one of the switch segments 15, 16 during the rotation of the lock cylinder or of the rotary rod 4 through approximately 40° to the right or to the left, respectively, is shown. There can also be, however, a second contact pin 14' in the switch-actuating part 10', which is located diametrically opposite the contact pin 14, e.g., in relation to the axis of rotation of the switch-actuating part 10', and which can be connected via its own electrical lead LA'. Now if the lock cylinder is rotatable beyond the said 40° rotary angles, with a suitable extension of the circumference of the switch segments 15, 16 the two contact pins can be brought simultaneously into contact with one of the switch segments, with the result that a further switch function can be performed.

Thus, with one contact pin 14 and one of the switch segments 15 or 16, a central locking system can be controlled in the unlocking or the locking direction, respectively. The switch 12' would then have the above-mentioned function of a pole-changing touch-contact switch with a neutral middle position, and an additional theft protection is switched on or off as a function of the direction of rotation of the lock cylinder only when each of the two contact pins are simultaneously brought into contact respectively with one of the switch segments 15 or 16. Of course, such a circuit is also possible with the conventional microswitches 12 shown in FIG. 1, if suitable switch cams NO are provided on the switch-actuating part 10.

The embodiments discussed above can also be provided on more than only one door or flap of a vehicle, in order, by way of the rotary-angle sensing devices to allow a multi-position operation of the closing, locking or protection means to be controlled. Thus, although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A device for sensing rotary angles of a lock cylinder in a key-actuated lock system, comprising:

at least one lock cylinder of at least one of a vehicle door;

a return spring for prestressing the at least one lock cylinder into a neutral position from which the at least one lock cylinder is rotatable by a key;

a follower rotatably mounted in a door interior space;

a driving coupling coupling the follower to the lock cylinder to allow a free-wheel rotational play therebetween, and said follower being further coupled to a securing element of a lock of the door;

a switch-actuating part rotationally coupled to the lock cylinder virtually free of play and rotatable synchronously therewith;

at least one control switch which is switchable by the switch-actuating part at specific rotary angles thereof and directly spatially adjacent thereto, wherein the switch-actuating part for the control switch is mounted behind the follower in relation to the lock cylinder on a carrier facing the interior of the vehicle and fixed to the door, the control switch is retained at least indirectly on the carrier, and at least the switch-actuating part and the control switch are sealed off in relation to the door interior space.

2. The device according to claim 1, wherein the switch-actuating part is rotationally coupled to the lock cylinder via a rotary rod, which has a one-piece extension passing through and beyond the follower to the region of switch-actuating part, the rotary rod having both driving elements for the follower and driving elements for the switch-actuating part, and a seal operatively arranged at a lead-through of the rotary rod through the carrier.

3. The device according to claim 1, wherein a common carrier part fastened to the carrier jointly fastens the control switch connected firmly to a feeder cable and the switch-actuating part on the carrier.

4. The device according to claim 3, wherein the switch-actuating part is rotationally coupled t the lock cylinder via a rotary rod, which has a one-piece extension passing through and beyond the follower to the region of switch-actuating part, the rotary rod having both driving elements for the follower and driving elements for the switch-actuating part and a seal operatively arranged at a lead-through of the rotary rod through the carrier.

5. The device according to claim 3, wherein cams are provided on an outer circumference of the switch-actuating part and correspond to a switch rocker for actuating the control switch, the control switch being configured as microswitches with switch rockers in the common carrier part in different planes relative to an axial extension of the switch-actuating part, and the cams being arranged in different planes of the outer circumference of the switch-actuating part corresponding to the planes of the switch rockers.

6. The device according to claim 5, wherein the switch-actuating part is rotationally coupled to the lock cylinder via a rotary rod, which has a one-piece extension passing through and beyond the follower to the region of switch-actuating part, the rotary rod having both driving elements for the follower and driving elements for the switch-actuating part, and a seal operatively arranged at a lead-through of the rotary rod through the carrier.

7. The device according to claim 3, wherein a switch contact of the control switch is connected fixedly to a lead and is arranged directly on the switch-actuating part, and at least one fixed contact of the control switch is arranged on the carrier part.

8. The device according to claim 7, wherein the switch-actuating part is rotationally coupled to the lock cylinder via a rotary rod, which has a one-piece extension passing through and beyond the follower to the region of switch-actuating part, the rotary rod having both driving elements for the follower and driving elements for the switch-actuating part, and a seal operatively arranged at a lead-through of the rotary rod through the carrier.

9. The device according to claim 7, wherein two fixed contacts of the control switch are arranged on the carrier part, two switch contacts of the control switch are each connected fixedly to its own lead and are directly arranged on the switch-actuating part, the two switch contacts being located diametrically opposite one another relative to an axis of rotation of the switch-actuating part, such that neither of the two switch contacts are in contact with a fixed contact in the neutral position of the lock cylinder, and at smaller rotary angles of the lock cylinder, only one specific switch contact is brought into contact with one of the fixed contacts as a function of the particular direction of rotation, while at larger rotary angles of the lock cylinder, both switch contacts are brought simultaneously into contact respectively with one of the fixed contacts.

10. The device according to claim 9, wherein the switch-actuating part is rotationally coupled to the lock cylinder via a rotary rod, which has a one-piece extension passing through and beyond the follower to the region of switch-actuating part, the rotary rod having both driving elements for the follower and driving elements for the switch-actuating part, and a seal operatively arranged at a lead-through of the rotary rod through the carrier.

11. The device according to claim 2, wherein a funnel contour is provided on the follower and on the switch-actuating part, respectively, for easier introduction of the rotary rod during installation of the lock cylinder.

12. The device according to claim 11, wherein the switch-actuating part is rotationally coupled to the lock cylinder via a rotary rod, which has a one-piece extension passing through and beyond the follower to the region of switch-actuating part, the rotary rod having both driving elements for the follower and driving elements for the switch-actuating part, and a seal operatively arranged at a lead-through of the rotary rod through the carrier.

13. The device according to claim 12, wherein a common carrier part fastened to the carrier jointly fastens the control switch connected firmly to a feeder cable and the switch-actuating part on the carrier.

14. The device according to claim 13, wherein cams are provided on an outer circumference of the switch-actuating part and correspond to a switch rocker for actuating the control switch, the control switch being configured as microswitches with switch rockers in the common carrier part in different planes relative to an axial extension of the switch-actuating part, and the cams being arranged in different planes of the outer circumference of the switch-actuating part corresponding to the planes of the switch rockers.

15. The device according to claim 3, wherein a sealing arrangement of the switch-actuating part and of the control switch relative to the door interior is provided between the switch-actuating part and the common carrier part.

16. The device according to claim 15, wherein cams are provided on an outer circumference of the switch-actuating part and correspond to a switch rocker for actuating the control switch, the control switch being configured as microswitches with switch rockers in the common carrier part in different planes relative to an axial extension of the switch-actuating part, and the cams being arranged in different planes of the outer circumference of the switch-actuating part corresponding to the planes of the switch rockers.

17. The device according to claim 15, wherein a switch contact of the control switch is connected fixedly to a lead and is arranged directly on the switch-actuating part, and at least one fixed contact of the control switch is arranged on the carrier part.

18. The device according to claim 1, wherein the carrier is configured as part of an inside panel of the door facing the interior of the vehicle.

19. The device according to claim 18, wherein a sealing arrangement of the switch-actuating part and of the control switch relative to the door interior is provided between the switch-actuating part and a common carrier part.

20. The device according to claim 19, wherein the switch-actuating part is rotationally coupled to the lock cylinder via a rotary rod, which has a one-piece extension passing through and beyond the follower to the region of switch-actuating part, the rotary rod having both driving elements for the follower and driving elements for the switch-actuating part, and a seal operatively arranged at a lead-through of the rotary rod through the carrier.

* * * * *